US007600701B2

(12) United States Patent
Jasper et al.

(10) Patent No.: US 7,600,701 B2
(45) Date of Patent: Oct. 13, 2009

(54) SPRAY HEAD AND DEVICE FOR DELIVERY OF A LIQUID

(75) Inventors: Bernhard Jasper, Waltrop (DE); Ralf Jordan, Dortmund (DE); Wilfred Otte, Neukirchen-Vluyn (DE)

(73) Assignee: Seaquist Perfect Dispensing GmbH, Dortmund (DE)

( * ) Notice: Subject to any disclaimer, the term of this patent is extended or adjusted under 35 U.S.C. 154(b) by 164 days.

(21) Appl. No.: 11/689,713

(22) Filed: Mar. 22, 2007

(65) Prior Publication Data

US 2008/0035756 A1 Feb. 14, 2008

(30) Foreign Application Priority Data

Aug. 11, 2006 (DE) ..... 20 2006 012 416 U

(51) Int. Cl.
*B05B 7/32* (2006.01)

(52) U.S. Cl. ..... 239/337; 239/391; 239/397; 239/442; 239/587.5; 222/402.13; 222/402.17; 222/533

(58) Field of Classification Search ..... 239/333, 239/337, 390, 391, 397, 436, 437, 442, 499, 239/587.5, 600; 222/402.1, 402.13, 402.17, 222/533, 534, 538
See application file for complete search history.

(56) References Cited

U.S. PATENT DOCUMENTS

| | | | | |
|---|---|---|---|---|
| 2,537,226 | A * | 1/1951 | Lindsey | 239/337 |
| 3,116,856 | A * | 1/1964 | Prussin et al. | 239/587.4 |
| 3,148,806 | A * | 9/1964 | Meshberg | 222/402.13 |
| 3,221,950 | A * | 12/1965 | O'Donnell | 222/534 |
| 3,402,862 | A * | 9/1968 | Meshberg | 222/402.13 |
| 4,858,792 | A * | 8/1989 | de Laforcade | 222/538 |
| 6,027,042 | A * | 2/2000 | Smith | 239/337 |
| 6,105,826 | A * | 8/2000 | Oursin et al. | 222/402.1 |
| 6,796,464 | B1 * | 9/2004 | Tung | 222/402.17 |

* cited by examiner

*Primary Examiner*—Steven J Ganey
(74) *Attorney, Agent, or Firm*—David S. Safran; Roberts Mlotkowski Safran & Cole, P.C.

(57) ABSTRACT

A spray head and a device for delivery of a liquid which enables the liquid to be delivered from a container to which the spray is connected both as a spray mist and as a jet. A first feature is that the delivery tube is shorter than the container diameter or the inside diameter of a protective cap for the container. A second feature is that the spray head—especially with the delivery tube which is and/or is not connected to the nozzle—does not project laterally beyond the perimeter of the container and/or fits under the protective cap. A third feature is that the delivery tube can be pivoted up away from the nozzle. A fourth feature is that the spray head has a groove-shaped top recess for holding the delivery tube. These features are usable singly or in combination.

22 Claims, 4 Drawing Sheets

SPRAY HEAD AND DEVICE FOR DELIVERY OF A LIQUID

BACKGROUND OF THE INVENTION

1. Field of the Invention

This invention relates to a spray head for delivery of a liquid and a device with a spray head, in which a delivery tube can be alternatively mounted in front of the nozzle of the spray head.

2. Description of Related Art

The term "liquid" here means especially also suspensions and fluids, optionally with gas phases. For example, it can be cleaning agents or lubricants or other liquids, for example, air fresheners, and especially also other technical liquids and fluids such as rust looseners, or the like.

A device with a spray head for delivery of a liquid is already known from practice, the spray head having a nozzle for atomization of the liquid into a spray mist. If necessary, a long delivery tube (the length corresponds especially essentially to the height of the longish container with the liquid) can be attached in front of the nozzle by insertion into the spray head in order to be able to deliver the liquid as a jet. The disadvantage is that the long delivery tube can be lost very easily, since it can be completely separated from the spray head.

Furthermore, a similar device is known in which the spray head projects laterally over the container and the long delivery tube can be folded onto the container or can be folded up to in front of the nozzle for delivery of the liquid as the jet. In this device, the problem is not that the delivery tube can be lost, but the disadvantage is that the laterally projecting spray head requires special mounting which cannot be carried out with the conventional mounting devices, that the delivery tube which hangs down laterally on the container can be damaged during improper transport or even torn off, that the delivery tube which hangs down laterally on the container can be perceived as disruptive to the user when the container is gripped and that a conventional covering or protective cap for covering the spray head does not fit on the container.

SUMMARY OF THE INVENTION

A primary object of this invention is to devise a spray head and a device for delivery of a liquid which enable alternative delivery of the liquid as a spray mist and jet, a compact structure and simple mounting being enabled and/or a conventional protective cap fitting on the spray head or the device or a container which contains a liquid.

A first aspect of this invention is that the delivery tube is shorter than the container diameter or the inside diameter of the protective cap.

A second aspect of this invention is that the spray head—especially with the delivery tube which is and/or is not connected to the nozzle—does not project laterally beyond the perimeter of the container and/or fits under the protective cap.

A third aspect of this invention is that the delivery tube can be folded up away from the nozzle.

A fourth aspect of this invention is that the spray head has a preferably groove-shaped and/or top recess for holding the delivery tube.

The aforementioned aspects enable individually and/or in combination an especially compact and simple structure, simple, intuitive operation being enabled, the delivery tube disrupting use as little as possible, and a conventional protective cap can be used, a lateral overhang of the spray head over the container not being not necessary, the danger of injury by the delivery tube being minimized, since it preferably does not project laterally over the container, and/or the delivery tube hanging down laterally on the container being avoided.

Other advantages features, properties and aspects of this invention will become apparent from the following description of a preferred embodiment with reference to the accompany drawings.

BRIEF DESCRIPTION OF THE DRAWINGS

FIG. 1 is a schematic sectional view of the top part of a device in accordance with the invention for delivery of a liquid with the delivery tube folded in;

DETAILED DESCRIPTION OF THE INVENTION

The same reference numbers are used for the same or similar parts in the figures, the corresponding or comparable properties and advantages being achieved even if a repeated description is omitted.

Figure 1:
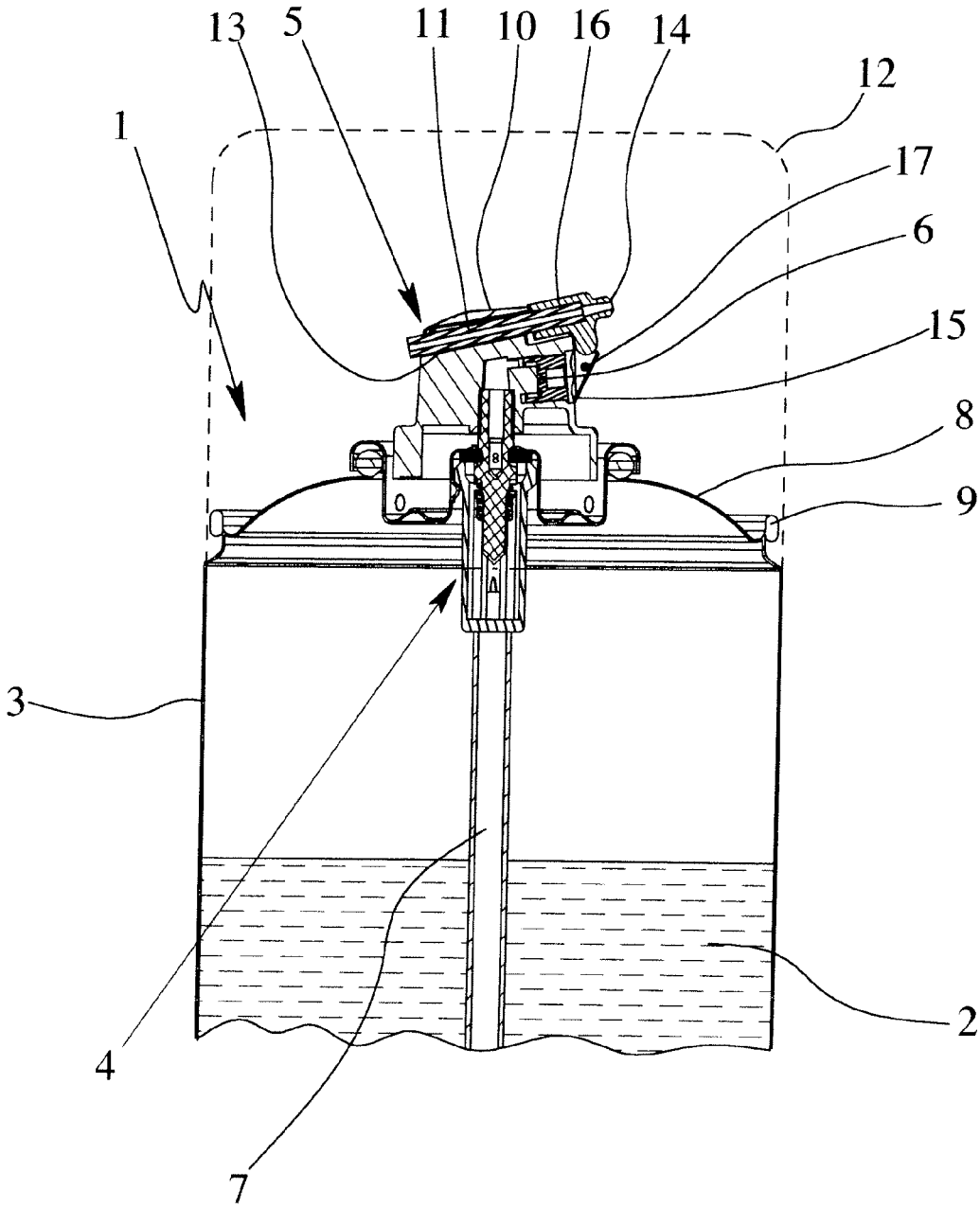

FIG. 1 shows a schematic section of the device 1 in accordance with the invention, especially a spray nozzle, for delivery of a liquid 2 in the initially mentioned sense.

The device 1 has a preferably longish and/or cylindrical and/or rigid container 3 with, especially, a metallic nozzle for discharging of the liquid 2 and a valve 4 which is located preferably on the front of the container 3.

The liquid 2 in the container 3 can either be pressurized or is under pressure. In particular, the container 3 or the liquid 2 contains a suitable propellant, preferably a volatile and/or flammable propellant, compressed gas and/or carbon dioxide.

A spray head 5 is attached to the container 3 or valve 4, especially after filling the container 3 with the liquid 2. In the illustrated embodiment, the spray head 5 is slipped on. However, it can, if necessary, also be detachably attached in some other suitable manner.

The spray head 5, on the dispensing side, has a nozzle 6 for atomization and delivery of the liquid 2. In the illustrated embodiment, the nozzle 6 is made as a separate part, and for example, is inserted subsequently into the spray head 5. However, the nozzle 6 can also be made integrally with the spray head 5, especially can be formed directly as part of it.

The spray head 5 is preferably produced by injection molding from a suitable plastic, and preferably, is made in one piece, optionally, with the exception of the nozzle 6.

Figure 2:
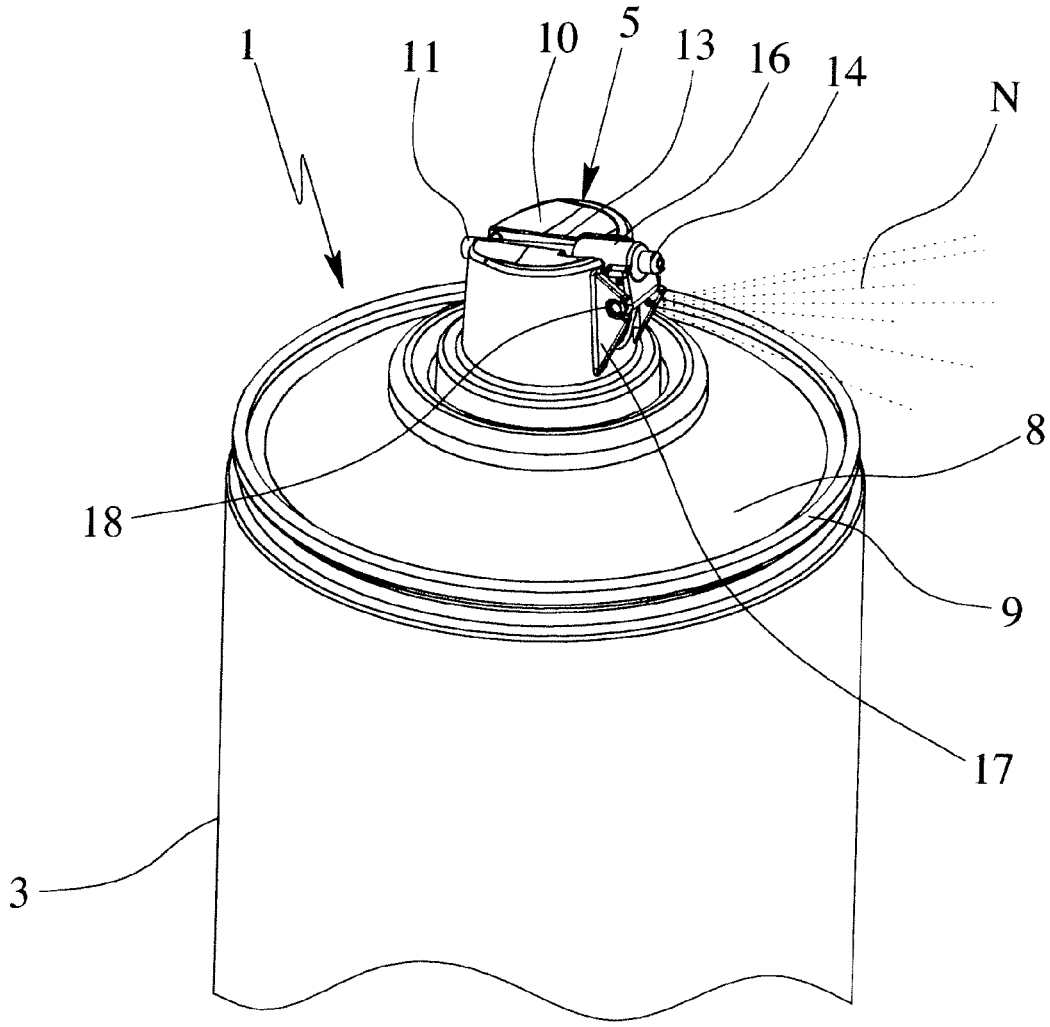
FIG. 2 is a perspective view of the top part of a device shown in FIG. 1.

When the valve 4 is actuated—in the illustrated embodiment by pressing down the spray head 5—the valve opens 4. The pressurized liquid 2 can flow especially via the ascending line 7 and through the valve 4 and can be delivered via the spray head 5, the liquid 2 emerging through the nozzle 6 and especially being atomized as a spray mist N, as is indicated in FIG. 2.

The spray head 5 is preferably made essentially cylindrical or rotationally symmetrical, especially preferably essentially in the shape of the truncated cone.

The spray head 5 is located preferably on the front and/or in the middle on the container 3, especially preferably adjacent to the cover 8 which closes the container 3. Especially preferably, the spray head 5 extends essentially in the axial direction with respect to the lengthwise axis of the container 3.

The cover 8 is conventionally connected to the container 3—especially in the region of one edge 9—for example, by crimping. The cover 8 carries or holds the valve 4 which for its part bears or holds the spray head 5, in the illustrated embodiment.

To actuate the spray head 5, especially to press it down, the spray head 5 is preferably provided with an actuating surface 10 which is made essentially flat or even or smooth and/or is located on the free end of the spray head 5 and/or is tilted slightly to the direction of actuation or the container axis. Especially preferably, the main direction of delivery of the nozzle 6—in the illustrated embodiment in FIG. 1 essentially horizontal—is inclined only slightly relative to the main plane of the actuating surface 10, in the illustrated embodiment, preferably less than 20 degrees.

It is noted that the diameter of the spray head 5 is preferably less than 50%, especially less than 40%, especially essentially 35%, of the diameter of the container 3 or the container edge 9.

The spray head 5 in accordance with the invention has a delivery tube 11 which can be connected alternately on the outlet side to the nozzle 6, especially can be folded to in front of the nozzle 6. By means of the delivery tube 11 the liquid 2 can be delivered alternately as a spray mist N (without a delivery tube 11 directly, compare FIG. 2) or as a jet S (through the delivery tube 11, compare FIG. 4).

Figure 3:
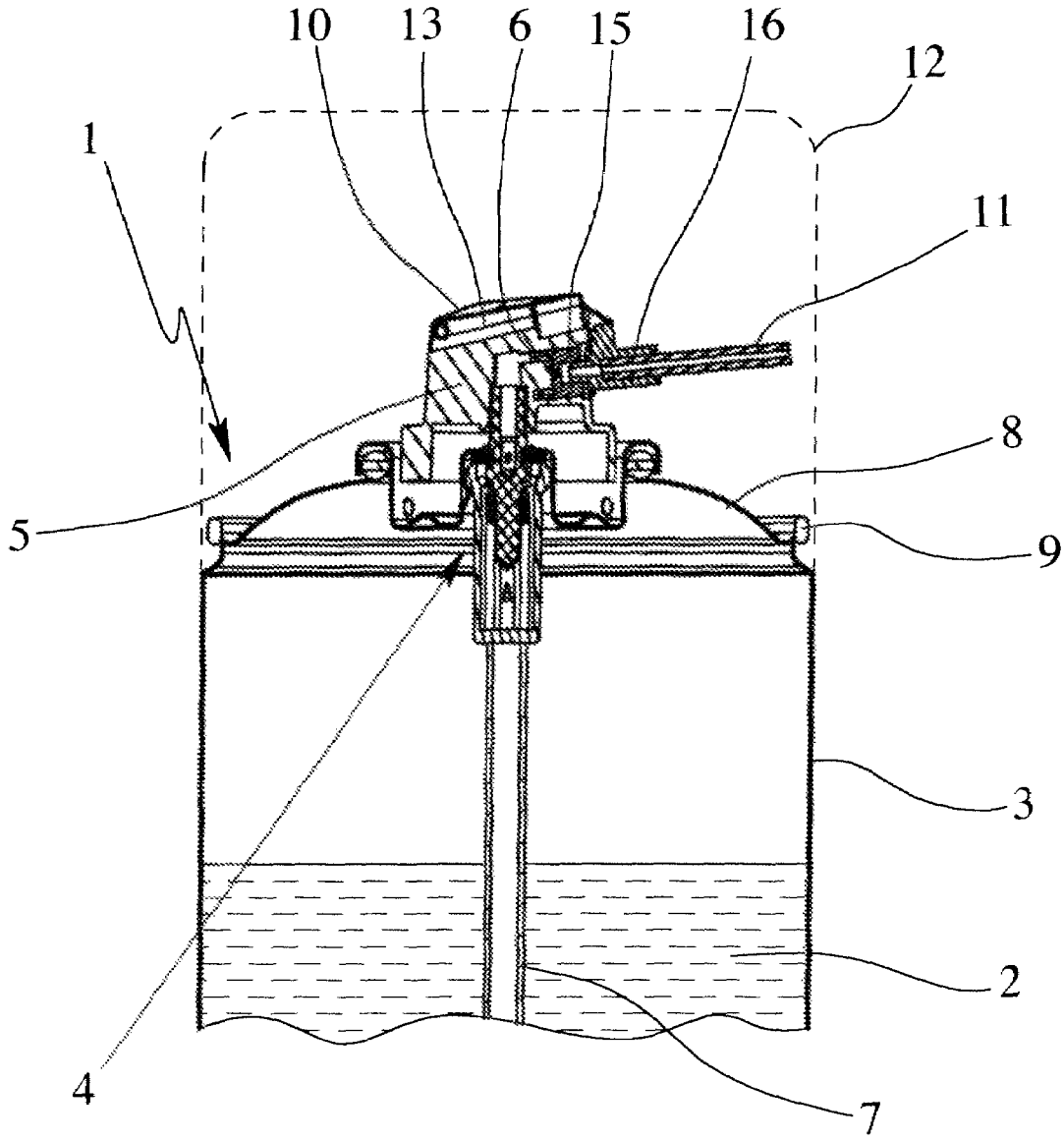
FIG. 3 is a schematic sectional view of the top part of the device corresponding to FIG. 1 with the delivery tube folded out.
Figure 4:
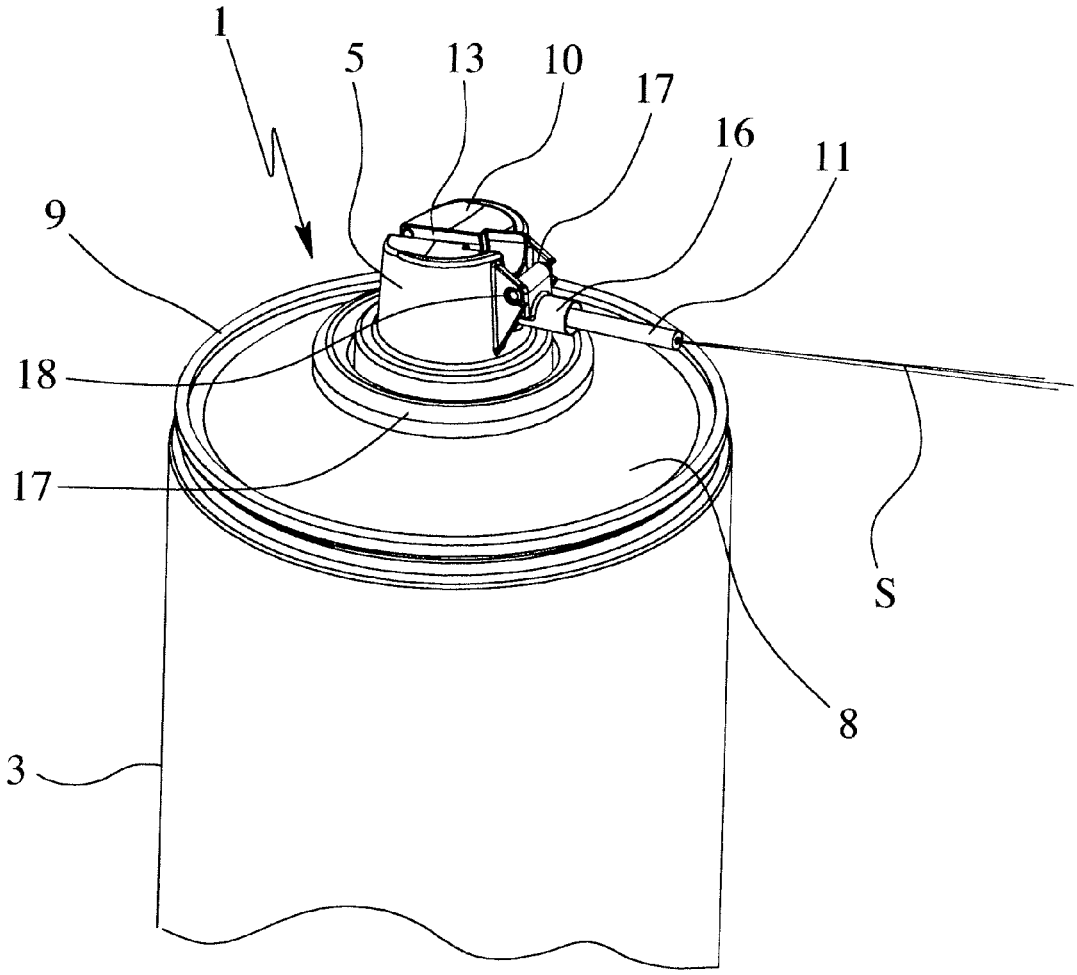
FIG. 4 is a perspective of the top part of the device as shown in FIG. 3.

FIGS. 1 & 2 show the device 1 in accordance with the invention with the spray head 5 in accordance with the invention with the delivery tube 11 pivoted up into a storage position in which it is received in a notch in the top of the spray head 5. FIGS. 3 & 4 show the spray head 5 with the delivery tube 11 swung down into its operative position.

FIG. 2 additional shows schematically how the liquid 2 is delivered directly from the nozzle 6 as the spray nozzle N. FIG. 4 schematically shows how the liquid 2 is delivered via the nozzle 6 and the adjoining delivery tube 11 as the spray jet S.

FIGS. 1 and 3 schematically show (broken line) an optional protective cap 12 which is used as a cover of the spray head 5 and can be especially clamped onto the container 3 or container edge 9, especially, can be slipped on it. In particular, the protective cap 12 is placed on the container 3 axially or on the front. The protective cap 12 is manually removed for use.

The delivery tube 11 is preferably shorter than the container diameter or the inside diameter of the protective cap 12.

Preferably it is provided that the spray head 5—especially with the delivery tube 1 connected and/or not connected to the nozzle 6—does not project laterally beyond the periphery of the container 3 or container edge 9 and/or fits under the protective cap 12. In particular, the protective cap 12 can therefore always be placed on the container independently of the pivoted position of the delivery tube 11.

Preferably, the delivery tube 11 can be folded up away from the nozzle 6. Especially preferably, the delivery tube 11 can be pivoted or folded around an axis 18 which runs in front of and/or above the nozzle 6.

Especially preferably, the spray head 5 has a preferably groove-shaped top recess 13 for holding the delivery tube 11. The recess 13 is formed especially in the actuating surface 10 of the spray head 5. Especially preferably, the recess 13 and the delivery tube 11 are matched to one another and/or the spray head 5 is made such that the delivery tube 11 can be held in the recess 13, without its projecting above the actuating surface 10. However, this does not preclude the delivery tube 11, in the storage position held in the recess 13, from projecting laterally beyond the spray head 5 or the actuating surface 10, as is indicated in FIGS. 1 & 2.

Preferably, the recess 13 and the delivery tube 11 are matched to one another such that the delivery tube 11, in the swung-up storage state in the recess 13 is held by clamping or catching in the recess 13.

The delivery tube 11 preferably cannot be detached from the spray head 5. However, the delivery tube 11, in a simplified version, can also be detachable from the spray head 5. Preferably, the delivery tube 11, in this case, can then be held by the recess 13, especially can be clamped into it. Alternatively, the recess 13 can also be made, for example, as a hole into which the delivery tube 11 can be inserted. In this case, the hole can run, for example, also transversely to the main delivery direction and/or axially or in the actuation direction of the spray head 5.

The delivery tube 11 is preferably straight and/or rigid. The length of the delivery tube 11 corresponds preferably is equal to the diameter of the spray head 5, but can exceed it by as much as 30%.

Preferably, the delivery tube 11 has a connecting section 14 and can be connected to a seal 15 of the nozzle 6, especially can be inserted into it. In the illustrated embodiment, the seal 15 is especially made annular or hollow-cylindrical and is located especially in front of the nozzle 6, for example, is held in a corresponding recess of the spray head 5.

The delivery tube 11 is provided especially preferably with an adapter 16, especially is held by it and/or inserted into it. In the illustrated embodiment, the adapter 16 forms the connecting section 14. Preferably, the adapter 16 is supported to be able to pivot on the spray head 16.

Especially preferably, the spray head 5 has at least one, preferably two holding devices 17, which are located laterally next to and/or above the nozzle 6 for pivotably supporting the delivery tube 11 or the adapter 16.

Especially preferably, the adapter 16 has lateral bearing projections 18 which form the pivot axis of the adapter and are which are clipped into the holding devices 17 or is pivotally connected to the spray head in some other way.

Preferably, the delivery tube 11 is held or can be fixed by clamping and/or catching in the swung-out active position in front of the nozzle 6.

What is claimed is:

1. Spray head for delivery of a liquid from a container to which the spray head is connectable, the spray head having a nozzle for atomization of the liquid, a delivery tube has an active position at which it is connected at an outlet end of the nozzle for delivering liquid as a spray mist and a storage position spaced above the outlet end of the nozzle for enabling a jet of liquid to be delivered from the nozzle, and an adapter by which the delivery tube is movable between said active and storage positions, the adapter being engageable in a seal of the nozzle for connecting the delivery tube to said nozzle in said the active position of the delivery tube, and wherein the spray head having at least one of the following features:

the delivery tube is shorter than a diameter of the container to which the spray head is connectable;

the spray head does not project laterally beyond the periphery of the container to which the spray head is connectable;

the delivery tube is pivotable away from the nozzle;

the spray head has a recess for holding the discharge tube in said storage position.

2. Spray head in accordance with claim 1, wherein the discharge tube is pivotable around an axis located at least one of in front of and above the nozzle.

3. Spray head in accordance with claim 1, wherein the delivery tube is permanently connected to the spray head.

4. Spray head in accordance with claim 1, wherein the delivery tube is at least one of straight and rigid.

5. Spray head in accordance with claim 1, wherein the length of the delivery tube corresponds at least essentially to the diameter of the spray head.

6. Spray head in accordance with claim 1, wherein the length of the delivery tube exceeds the diameter of the spray head by at most 30%.

7. Spray head in accordance with claim 1, wherein said at least one feature includes the spray head having a recess for holding the discharge tube in said storage position, the recess being formed in an actuating surface of the spray head.

8. Spray head in accordance with claim 7, wherein the recess and the delivery tube are matched to one another such that the delivery tube can be held in the recess without the delivery to projecting above the actuating surface.

9. Spray head in accordance with claim 7, wherein the recess for holding the delivery tube is groove-shaped.

10. Spray head in accordance with claim 1, wherein the adapter is pivotally supported on the spray head.

11. Spray head in accordance with claim 1, wherein the spray head has at least one, holding device which is located next to the nozzle which pivotally supports the delivery tube.

12. Spray head in accordance with claim 11, wherein an adapter is to which the delivery tube is connected is clipped into the at least one holding device.

13. Spray head in accordance with claim 1, wherein the delivery tube is lockable by catching or by clamping in at least one of the active position in front of the nozzle and the storage position.

14. Device for delivery of a liquid, comprising a container which contains a liquid, and a spray head which is attached to the container, the spray head having a nozzle for atomization of the liquid, a delivery tube which is connectable to an outlet end of the nozzle to deliver the liquid as a spray mist or jet, and an adapter by which the delivery tube is movable between an active position connected to the nozzle and a storage position in which the delivery tube is disengaged and displaced away from nozzle, the adapter being engageable in a seal of the nozzle for connecting the delivery tube to said nozzle in said the active position of the delivery tube, and wherein the spray head having at least one of the following features:

the delivery tube is shorter than the container diameter;

the spray head does not project laterally beyond the periphery of the container;

the delivery tube is mounted to swing up away from the nozzle;

the spray head has a recess for holding the discharge tube.

15. Device in accordance with claim 14, wherein the container has a protective cap and the delivery tube is shorter than an inside diameter of the protective cap of the container.

16. Device in accordance with claim 14, wherein the container has a protective cap and wherein the spray head together with the delivery tube fits under the protective cap of the container.

17. Device in accordance with claim 14, wherein the liquid in the container is under pressure.

18. Device in accordance with claim 14, wherein the container is provided with a valve on which the spray head is located.

19. Device in accordance with claim 14, wherein the device is operative for delivering the liquid via the spray head by pressing the spray head down.

20. Device in accordance with claim 14, wherein said at least one feature includes the spray head having a recess for holding the discharge tube, the recess being formed in an actuating surface of the spray head.

21. Device in accordance with claim 14, wherein said at least one feature includes the delivery tube being mounted to swing up away from the nozzle; the discharge tube being pivotable around an axis located at least one of in front of and above the nozzle.

22. Device in accordance with claim 14, wherein the length of the delivery tube exceeds the diameter of the spray head by at most 30%.

* * * * *